US009878256B2

(12) United States Patent
Jones

(10) Patent No.: US 9,878,256 B2
(45) Date of Patent: Jan. 30, 2018

(54) COMBINATION STUFFED CHARACTER AND SLEEPING BAGS

(71) Applicant: Cameron Jones, Cranberry Township, PA (US)

(72) Inventor: Cameron Jones, Cranberry Township, PA (US)

( * ) Notice: Subject to any disclaimer, the term of this patent is extended or adjusted under 35 U.S.C. 154(b) by 0 days.

(21) Appl. No.: 14/554,881

(22) Filed: Nov. 26, 2014

(65) Prior Publication Data

US 2016/0008725 A1 Jan. 14, 2016

Related U.S. Application Data

(60) Provisional application No. 62/022,616, filed on Jul. 9, 2014.

(51) Int. Cl.

| | |
|---|---|
| ***A63H 3/00*** | (2006.01) |
| ***A47G 9/08*** | (2006.01) |
| ***A63H 3/02*** | (2006.01) |

(52) U.S. Cl.

CPC ..... *A63H 3/003* (2013.01); *A47G 9/08* (2013.01); *A63H 3/02* (2013.01)

(58) Field of Classification Search

CPC ..... A63H 3/003; A63H 3/02; A63H 3/005; A63H 33/00; A47G 9/00; A47G 9/08; A47G 9/083; A47G 9/1045

See application file for complete search history.

(56) References Cited

U.S. PATENT DOCUMENTS

| | | | | | |
|---|---|---|---|---|---|
| 3,789,547 | A * | 2/1974 | Chemarin | A63H 3/02 | 428/100 |
| 4,236,263 | A * | 12/1980 | Allee | A47G 9/083 | 2/69.5 |
| 4,774,734 | A | 10/1988 | Mills | | |
| 4,856,131 | A | 8/1989 | Mills | | |

(Continued)

FOREIGN PATENT DOCUMENTS

| | | | |
|---|---|---|---|
| CN | 2334464 | | 8/1999 |
| CN | 202553198 | | 11/2012 |
| CN | 202553198 | U * | 11/2012 |

OTHER PUBLICATIONS http://www.treehugger.com/sustainable-product-design/feed-your-kids-to-a-shark-shaped -sleeping-bag.html Jun. 3, 2014.

*Primary Examiner* — Gene Kim
*Assistant Examiner* — Alyssa Hylinski
(74) *Attorney, Agent, or Firm* — Bartony & Associates, LLC

(57) ABSTRACT

A sleeping bag system has the appearance of a stuffed character when not in use as a sleeping bag and includes a torso including a torso compartment therein, a first limb having a first arm compartment therein which is in connection with the torso compartment, a second limb having a second arm compartment therein which is in connection with the torso compartment, at least a third limb having at least a first leg compartment therein which is in connection with the torso compartment. The sleeping bag system further includes an opening in the torso providing access to the torso compartment from outside of the sleeping bag system and an item removably storable in the torso compartment which is adapted to provide stability to the sleeping bag system such that the sleeping bag system can sit upright without support when not in use as a sleeping bag.

18 Claims, 10 Drawing Sheets

(56) References Cited

U.S. PATENT DOCUMENTS

| | | | | |
|---|---|---|---|---|
| 5,093,947 | A | 3/1992 | Henegar | |
| 5,226,193 | A | 7/1993 | Chen | |
| 5,515,559 | A | 5/1996 | Benson | |
| 5,643,037 | A * | 7/1997 | Altschul | A63H 3/006 446/28 |
| 5,815,833 | A | 10/1998 | Kuo | |
| 6,334,221 | B1 * | 1/2002 | Hope | A41D 10/00 2/69 |
| 6,343,968 | B1 * | 2/2002 | Louie | A45F 4/08 2/69.5 |
| 6,415,442 | B1 | 7/2002 | Smith | |
| 6,421,852 | B1 * | 7/2002 | Shao | A63H 3/005 446/73 |
| 6,427,267 | B1 | 8/2002 | Turner | |
| 6,434,769 | B1 * | 8/2002 | Koenig | A47D 15/00 446/369 |
| 6,494,532 | B1 | 12/2002 | Brosnan | |
| 6,591,426 | B1 * | 7/2003 | Smith | A41B 13/06 2/69 |
| 6,757,922 | B2 | 7/2004 | Chancey | |
| 7,367,070 | B2 * | 5/2008 | Akkad | A47D 11/00 5/413 R |
| 7,410,403 | B1 | 8/2008 | Altschul | |
| 7,461,421 | B1 * | 12/2008 | Faircloth | A47G 9/1045 5/630 |
| 7,987,536 | B1 | 8/2011 | Habig | |
| 8,166,572 | B1 | 5/2012 | Campbell | |
| 8,578,515 | B1 | 11/2013 | Petersen | |
| 2007/0180615 | A1 * | 8/2007 | Yang | A47G 9/083 5/414 |
| 2012/0329358 | A1 | 12/2012 | Cupid | |

* cited by examiner

COMBINATION STUFFED CHARACTER AND SLEEPING BAGS

CROSS-REFERENCE TO RELATED APPLICATIONS

This application claims benefit of U.S. Provisional Patent Application Ser. No. 62/022,616, filed Jul. 9, 2014, the disclosure of which is incorporated herein by reference.

BACKGROUND

The following information is provided to assist the reader in understanding technologies disclosed below and the environment in which such technologies may typically be used. The terms used herein are not intended to be limited to any particular narrow interpretation unless clearly stated otherwise in this document. References set forth herein may facilitate understanding of the technologies or the background thereof. The disclosure of all references cited herein are incorporated by reference.

Sleeping bags for children are often ornamented with various features to make them more attractive to and enjoyable for the children. Some sleeping bags may, for example, be ornamented with pictures of animals, animal heads etc. In general, such sleeping bags are designed to be rolled up after use for storage and do not provide entertainment for a child when not in use as a sleeping bag.

SUMMARY

In one aspect, a sleeping bag system hereof has the appearance of a stuffed character when not in use as a sleeping bag. The sleeping bag system includes a torso including a torso compartment therein, a first limb having a first arm compartment therein which is in connection with the torso compartment, a second limb having a second arm compartment therein which is in connection with the torso compartment, at least a third limb having at least a first leg compartment therein which is in connection with the torso compartment. The sleeping bag system further includes an opening in the torso providing access to the torso compartment from outside of the sleeping bag system and an item removably storable in the torso compartment. In a number of embodiments, the item provides stability to the sleeping bag system such that the sleeping bag system can sit upright without support when not in use as a sleeping bag. In a number of embodiments, the sleeping bag further includes a fourth limb having a second leg compartment therein which is in connection with the torso compartment. The opening in the torso may, for example, include a flap which is openable and closeable via at least one hook-and-loop type fastener.

In a number of embodiments, the first limb includes a connector in the vicinity of a distal end of the first limb and the second limb includes a cooperating connector in the vicinity of a distal end of the second limb such that the first limb and the second limb are connectable in front of the torso. The connector and the cooperating connector may, for example, be hook-and-loop type connectors. As clear to those skilled in the art, other connectors such as snaps, zippers, buttons etc. can be used in the sleeping bag systems hereof.

The sleeping bag system may, for example, further include a head attached to the torso which is tiltable rearward to create a head compartment in connection with the torso compartment. In a number of embodiments, the first limb includes an opening in the vicinity of the distal end thereof via which a first hand of a user of the sleeping bag may exit the sleeping bag, and the second limb includes an opening in the vicinity of the distal end thereof via which a second hand of a user of the sleeping bag may exit the sleeping bag. The third limb may, for example, include an opening in the vicinity of the distal end thereof, and the fourth limb (when present) may, for example, include an opening in the vicinity of the distal end thereof. The openings in the third limb and further limb may provide access for the user's feet. Openings in the distal ends of limbs may also provide ventilation.

The item may, for example, include an opening in connection with a storage compartment within the item. In a number of embodiments, the stuffed character is a stuffed animal and the item is formed in the shape of a food item for the animal.

In another aspect, a sleeping bag system has the appearance of a stuffed character when not in use as a sleeping bag. The sleeping bag system includes a torso having a torso compartment therein, a first limb having a first arm compartment therein, which is in connection with the torso compartment, a second limb having a second arm compartment therein, which is in connection with the torso compartment, at least a third limb having a first leg compartment therein, which is in connection with the torso compartment, an opening in the torso providing access to the torso compartment, and a stuffed head movably attached to the torso so that the head may be tilted rearward to create head compartment, which is connection with the torso compartment. In a number of embodiments, the sleeping bag system further includes a fourth limb having a second leg compartment therein which is in connection with the torso compartment.

In a number of embodiments, at least a portion of the first limb, at least a portion of the second limb, at least a portion of the third limb, and at least a portion of the fourth limb (when present) comprise at least one layer of a flexible material having sufficient rigidity to prevent substantial collapse of the first limb, the second limb, the third limb and the fourth limb (when present) when the sleeping bag is not in use as a sleeping bag. In a number of embodiments, the entirety of the limbs do not substantially collapse when the sleeping bag is not in use as a sleeping bag. The sleeping bag system may further include an item removably storable in the torso compartment to provide stability to the sleeping bag system when not in use as a sleeping bag.

The present devices, systems, and methods, along with the attributes and attendant advantages thereof, will best be appreciated and understood in view of the following detailed description taken in conjunction with the accompanying drawings.

DETAILED DESCRIPTION

Figure 1:
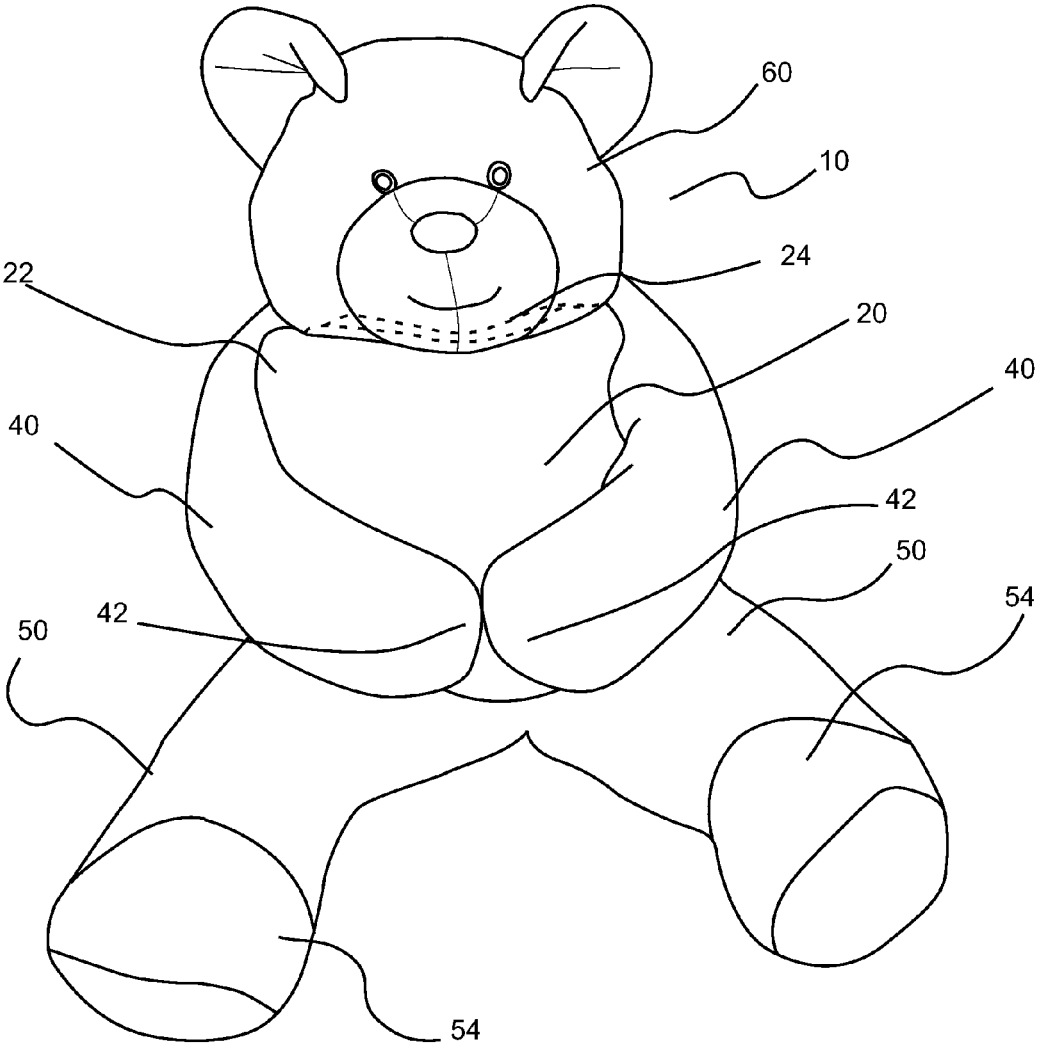
FIG. 1 illustrates a perspective view an embodiment of a sleeping bag hereof in the form of a bear or teddy bear in an, unsupported sitting position.

It will be readily understood that the components of the embodiments, as generally described and illustrated in the figures herein, may be arranged and designed in a wide variety of different configurations in addition to the described representative embodiments. Thus, the following more detailed description of the representative embodiments, as illustrated in the figures, is not intended to limit the scope of the embodiments, as claimed, but is merely illustrative of representative embodiments.

Reference throughout this specification to "one embodiment" or "an embodiment" (or the like) means that a particular feature, structure, or characteristic described in connection with the embodiment is included in at least one embodiment. Thus, the appearance of the phrases "in one embodiment" or "in an embodiment" or the like in various places throughout this specification are not necessarily all referring to the same embodiment.

Furthermore, described features, structures, or characteristics may be combined in any suitable manner in one or more embodiments. In the following description, numerous specific details are provided to give a thorough understanding of embodiments. One skilled in the relevant art will recognize, however, that the various embodiments can be practiced without one or more of the specific details, or with other methods, components, materials, et cetera. In other instances, well known structures, materials, or operations are not shown or described in detail to avoid obfuscation.

As used herein and in the appended claims, the singular forms "a," "an", and "the" include plural references unless the context clearly dictates otherwise. Thus, for example, reference to "an item" includes a plurality of such items and equivalents thereof known to those skilled in the art, and so forth, and reference to "the item" is a reference to one or more such items and equivalents thereof known to those skilled in the art, and so forth. Recitation of ranges of values herein are merely intended to serve as a shorthand method of referring individually to each separate value falling within the range. Unless otherwise indicated herein, and each separate value, as well as intermediate ranges, are incorporated into the specification as if individually recited herein. All methods described herein can be performed in any suitable order unless otherwise indicated herein or otherwise clearly contraindicated by the text.

In a number of embodiments hereof, sleeping bags are designed to represent an inanimate version of an animated figure or character such as an animal, a human action figure, a fantasy subject, etc., which are of sufficient size to allow a person (in a number of embodiments, a child) to sleep within the sleeping bag. In a number of embodiments, the animals are quadruped animals (that is, animals having four feet or limbs) that a child would find to be cute, safe and/or inviting. However, the sleeping bags may be designed as a fish, a bird, a human etc. As used herein, the term "limb", when referring to an animal in the shape of which a sleeping bag hereof is formed, refers to any appendage extending from the torso or main body portion of an animal. For example, a tail or a fin is considered a limb of a fish, and wings or legs are considered limbs of birds. In a number of embodiments, the sleeping bags hereof include a hollow torso or main body for enclosing the torso of the child, two hollow arm compartments for into which a child may insert each of the child's arms, one or more hollow leg compartments into which a child may insert each of the child's legs, and a carved out head compartment where child's head may rest. For example, FIGS. 1 through 6 illustrate an embodiment of a combination stuffed animal and sleeping bag 10 (sometimes referred to herein as sleeping bag 10) in the form of a bear or teddy bear. Torso 20 includes an opening in the form of a flap 22 (see, for example, FIG. 2A) via which a person/child may enter the sleeping bag. Other types of openings may be used as known in the sleeping bag arts. Flap 22 may, for example, include one or more fasteners 24*a* which cooperate with cooperating fasteners 24*b* to open and close flap 22. In a number of embodiments, fasteners 24*a* and cooperating fasteners 24*b* are hook-and-loop type fasteners such as VELCRO® available from Velcro USA, Inc. of Manchester, N.H. Use of hook-and-loop type fasteners may, for example, provide for ease of use for a child and for ready exit from sleeping bag 10. Other types of fastening mechanisms (for example, snaps, zippers, buttons etc.) may be used in sleeping bag 10 as known in the art.

Figure 2A:
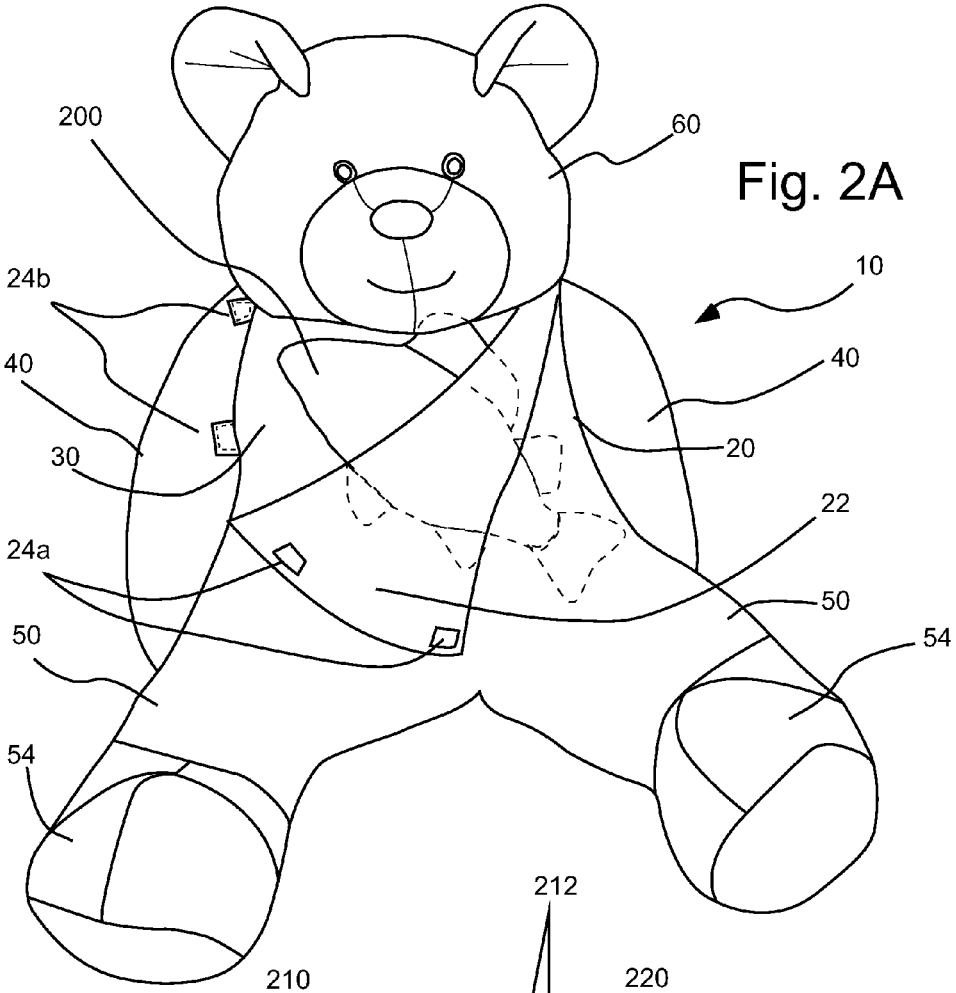
FIG. 2A illustrates another perspective view of the sleeping bag of FIG. 1 in a sitting position and in which the bag is in a partially open state and showing an item such as a food item in the form of a fish within the sleeping bag.
Figure 4A:
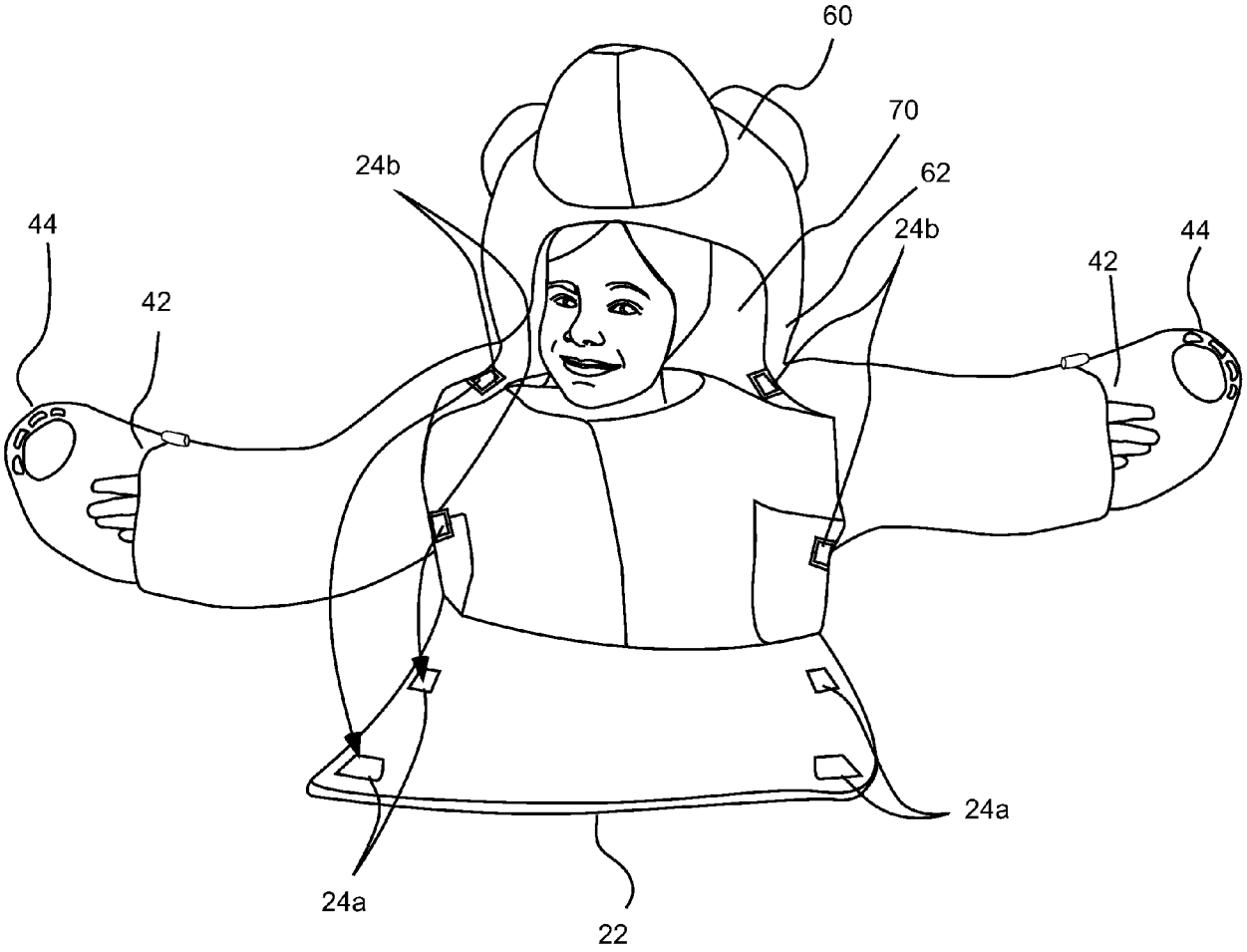
FIG. 4A illustrates a perspective view of an upper section of the sleeping bag of FIG. 1 with a child therein.
Figure 4B:
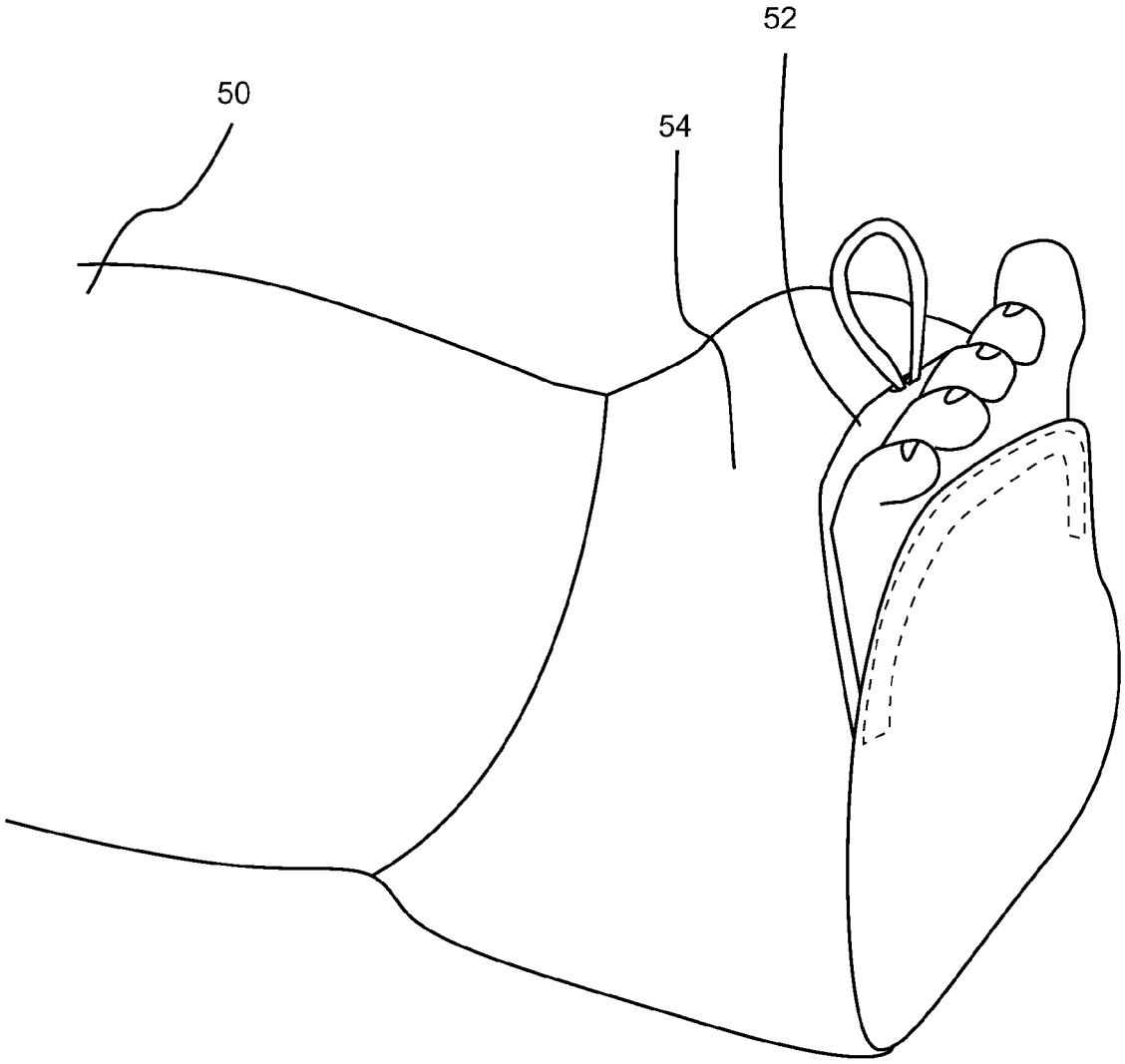
FIG. 4B illustrates an enlarged perspective view of a foot section of the sleeping bag of FIG. 1 showing an opening which can operate to vent the sleeping bag.
Figure 5:
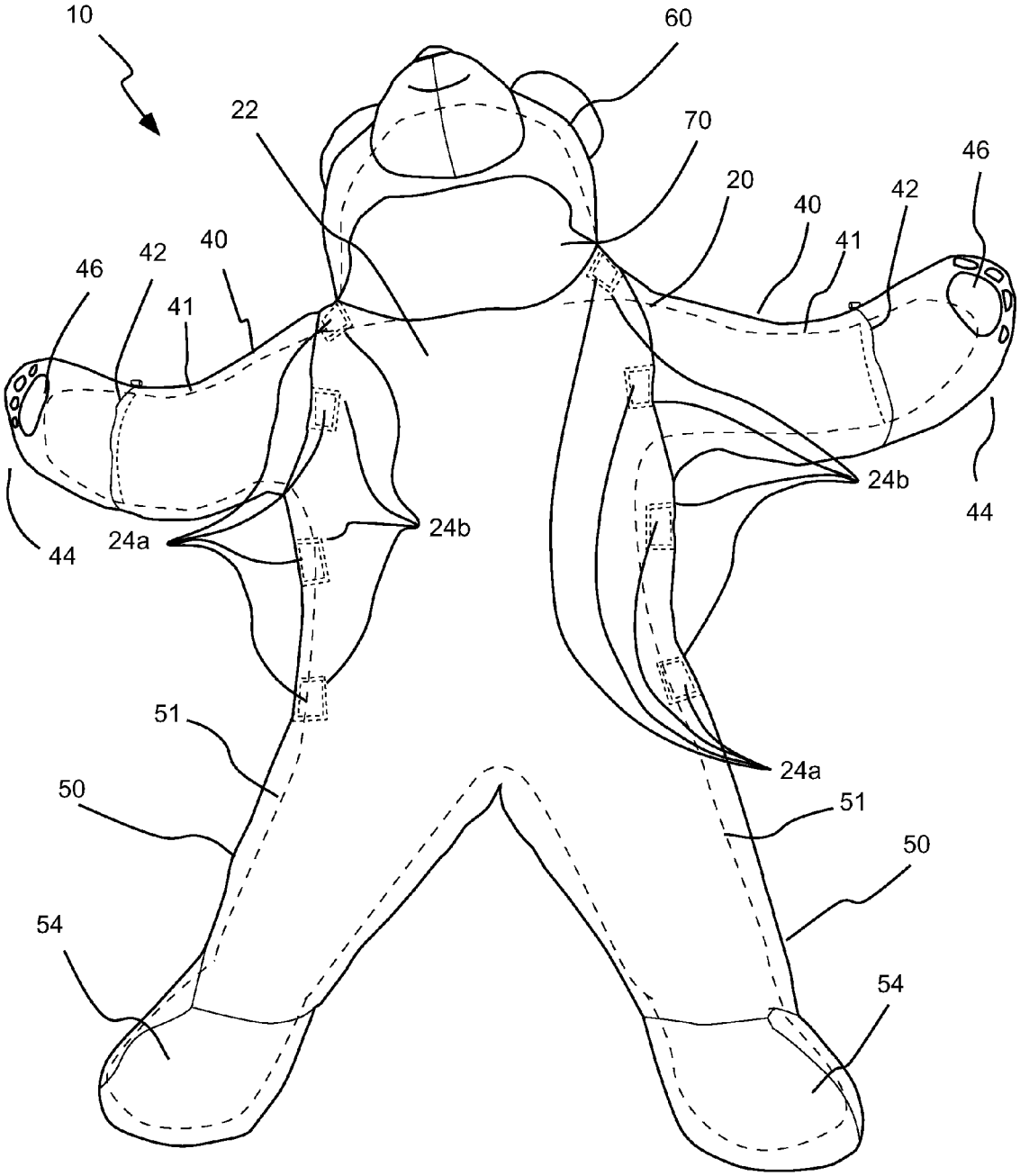
FIG. 5 illustrates another perspective view of the sleeping bag of FIG. 1 showing the various compartments within the sleeping bag in dashed lines.
Figure 6:
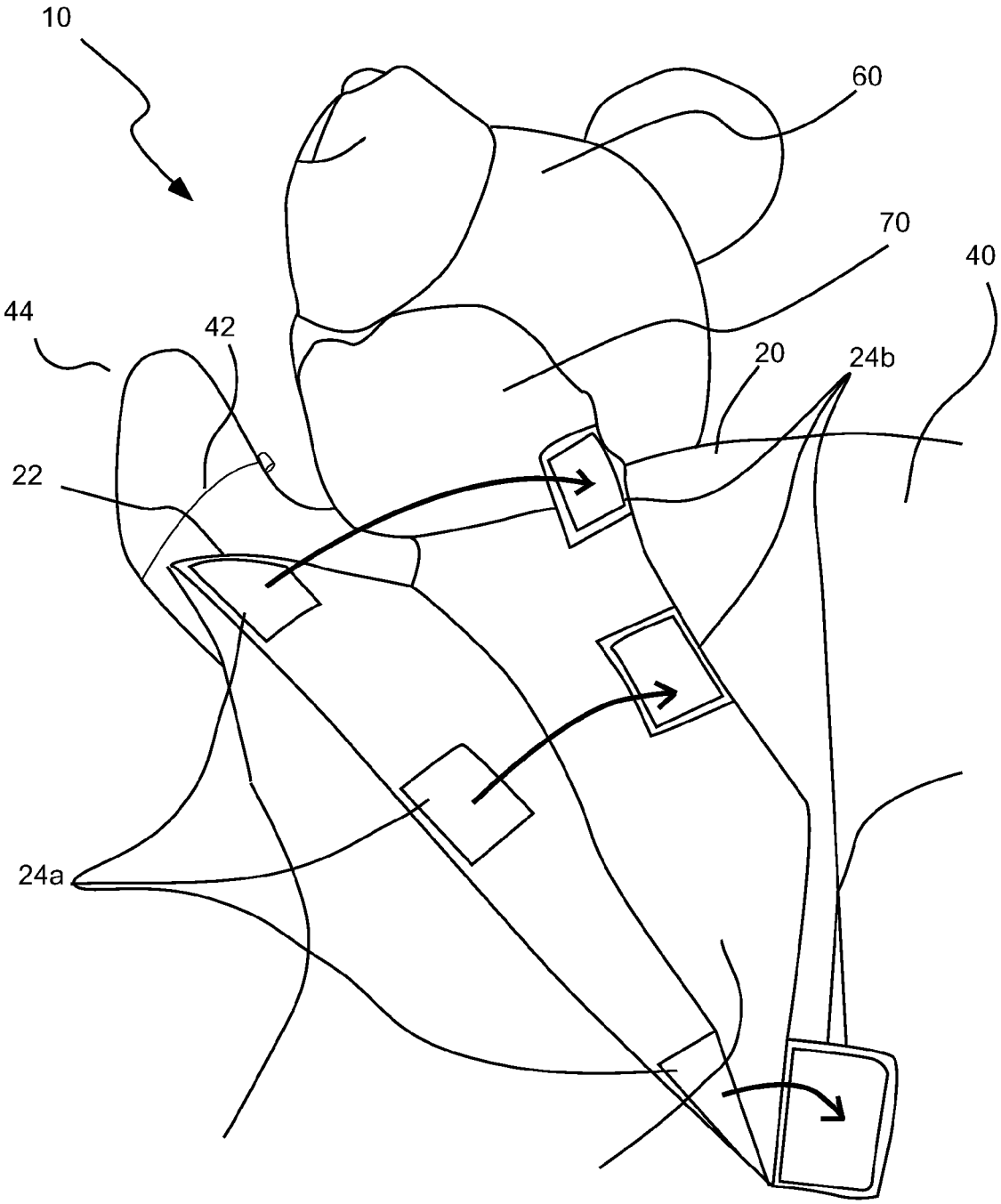
FIG. 6 illustrates a perspective view of an upper section of the sleeping bag of FIG. 1 in an open state, showing hook-and-loop types fastener that may be used to open and close the bag.

As, for example, illustrated in FIG. 4A, a child may enter a torso compartment or volume 30 within main body or torso 20 of sleeping bag 10 through an opening created by flap 22 which folds open as illustrated in FIGS. 2A and 4A. Arms (front limbs or legs, referring to the form of the bear) 40 and legs (rear limbs or legs, referring to the form of the bear) 50 of sleeping bag 10 are hollow to form arm compartments 41 and leg compartments 51 which open into torso compartment 30 so that the child may place his or her arms and legs into arm compartments 41 within arms 40 and the leg compartments 51 within legs 50 of sleeping bag 10 (see FIG. 5). In the illustrated embodiment, arms 40 have openings 42 (see FIG. 4A) located near paws 44 (at a distal end of arms 40) at approximately the wrist position of the child to provide freedom of movement for the child's hands, to provide ventilation and/or for handling purposes. Freedom of the child's hands and fingers may, for example, provide for ready access to flap 22 to allow the child to readily exit sleeping bag 10. Legs 50 similarly may have openings 52 located near paws 44 at the area of the child's feet to, for example, provide access and for ventilation purposes.

In a number of embodiments, head 60 (or at least an upper portion of head 60) of sleeping bag 10 is formed and stuffed/filled in a manner of a typical stuffed animal or teddy bear head (in the embodiment of FIGS. 1 through 6), but is connected to torso 20 and arms 40 in a manner (for example, via a length of material 62 as illustrated in FIG. 4A) so that head 60 can be tilted back in the manner of a hood to provide a head compartment 70 for the child's head (see, for example, FIGS. 3 and 4A) when the child is within sleeping bag 10. In a number of embodiment, the entire head 60 of sleeping bag 10 is stuffed (for example, to the beginning of the neck anatomically.

In a number of embodiments, once inside stuffed animal/sleeping bag 10 and fastened closed, the child is generally completely enclosed inside sleeping bag 10. In general, sleeping bag 10 is not designed for a child to easily stand upright when within sleeping bag 10 and/or to become mobile. However, access to the child's hands via openings 42 and the child's feet via openings 52 may provide a limited ability to mover/stand or otherwise use the hands and/or feet in, for example, an emergency or perceived emergency to, for example, allow the child to readily exit sleeping bag 10.

As described above, when sleeping bag 10 is not used as a sleeping bag, it may, for example, function as a stuffed animal. In a number of embodiments, sleeping bag 10, when used in a "stuffed animal mode", may sit upright without support other than provided by sleeping bag 10 itself. As used herein, the ability to "sit upright" (while unsupported) refers to a position as, for example, illustrated in FIG. 2D in which the character/stuffed animal rests upon its seat (or lower torso) and the lower limb(s) of the stuffed animal may extend forward. In a number of embodiments, a line A drawn from the center of head 60 and/or through the center of torso 20 to a flat, horizontally oriented surface upon which sleeping bag 10 is positioned is within an angle $\alpha$ (rearward or forward) with respect to a vertical position (that is, aligned with the orientation of gravity). In a number of embodiments, a is not more than 30°, no more than 20°, or no more than 15°. As used herein, the term "unsupported" refers to a state in which sleeping bag 10 is not supported physically (or touching any supporting object) other than the flat, horizontally oriented surface upon which sleeping bag 10 is positioned/sitting.

Figure 2B:
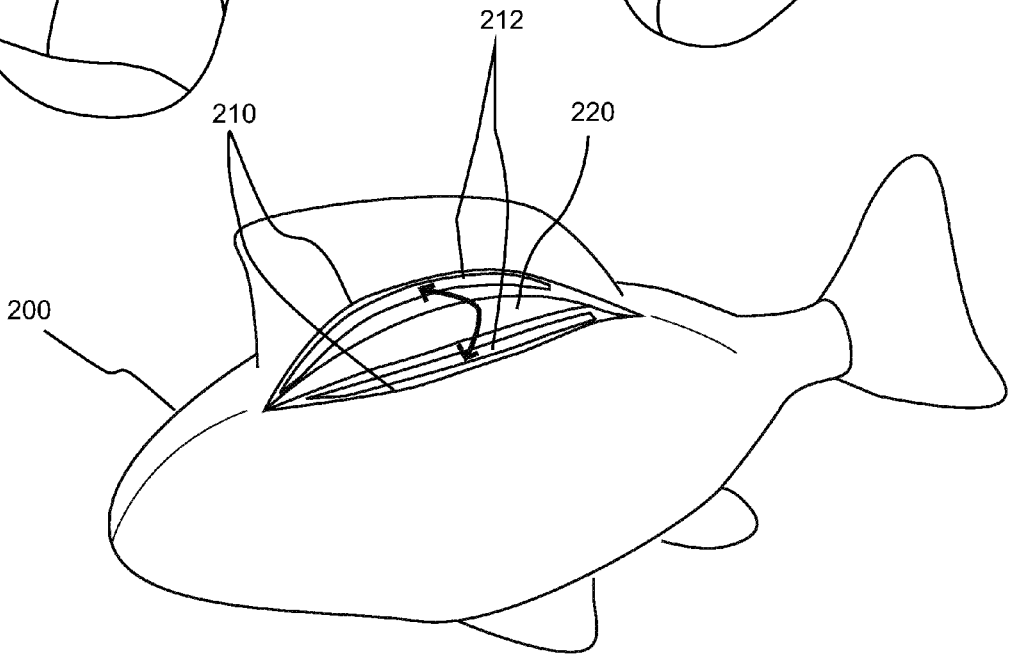
FIG. 2B illustrates an enlarged perspective view of the fish-shaped item of FIG. 2B, which can serve as an overnight bag, wherein the fish-shaped item is in a partially open state.
Figure 2C:
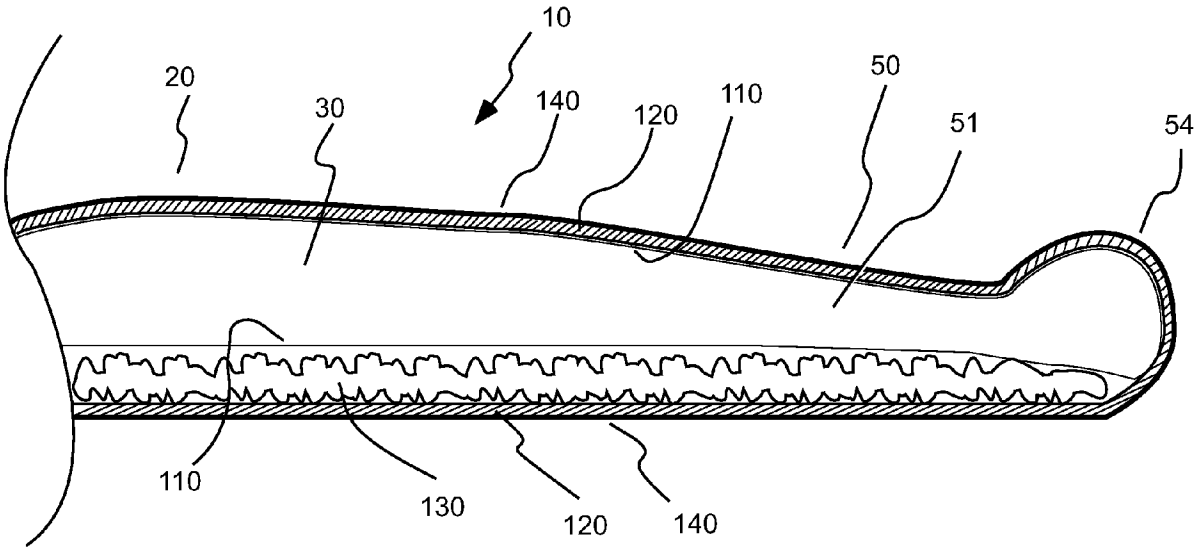
FIG. 2C illustrates a cross-sectional view of a portion of the sleeping bag of FIG. 1.

FIG. 2C illustrates a cross-sectional view of a portion of stuffed animal 10, illustrating the fabrication thereof. In the illustrated embodiment, sleeping bag 10 includes an inner lining layer 110 of a material such as a polyester. Inner layer 110 may, for example, provide a smooth and soft surface which contacts the child. In the illustrated embodiment, a support layer 120 of, for example, a batting material is outside of lining layer 110. Support layer 120 (in conjunction with other layers) is resilient and flexible but has sufficient rigidity or stiffness to provide structural support to, for example, assist in retaining the shape of sleeping bag 10 when the child is not within sleeping bag 10 (that is, during use as a stuffed animal). Still further, support layer 120 provides stability for a fill layer 130 (positioned between inner layer 110 and support layer 120 on a rearward side of sleeping bag 10) to ensure that fill layer 130 lays smooth. In several embodiments, a polyester batting material having a thickness of ⅜ inches (0.953 cm) (available, for example, from Fairfield Processing of Danbury, Conn. under the mark POLY-FIL®) was used as support layer 120. Batting and similar materials provide a soft, resilient and flexible material, but, by providing batting having a sufficient thickness, sufficient rigidity or stiffness can be achieved to retain the shape stuffed animal over at least a portion of sleeping bag 10 when not used as a sleeping bag.

Figure 2E:
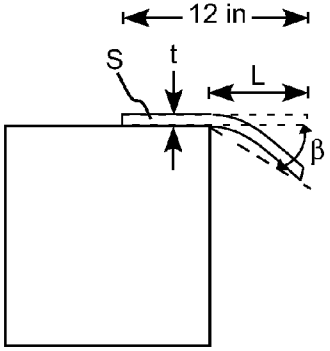
FIG. 2E illustrates an embodiment of a test to determine a material of sufficient rigidity or stiffness for use as a support layer in the sleeping bags hereof.

One skilled in the art can readily determine materials suitable for use in support layer 120. FIG. 2E, for example, illustrates a simple flexural or cantilever test for measuring rigidity or stiffness to determine materials suitable for use in support layer 120. In the illustrated test, a 12 inch (30.48 cm) length of a strip S of material, having a width of 1 inch (2.54 cm) and a thickness t suitable for use in sleeping bag 10, is extended over the edge of surface to a length L of 6 inches (15.24 cm). Strip S is allowed to bend under its own mass. An angle $\beta$ is measured (or a distance of bending is measured) to provide a measure of stiffness or rigidity. In a number of embodiments, the thickness of the material for support layer is in the range of approximately 0.25 (0.635 cm) and 0.75 (1.905 cm) inches or between approximately 0.25 (0.635 cm) and 0.5 inches (1.27 cm), and the angle $\beta$ is no more than 45 degrees or no more than 30 degrees. Tests for determining stiffness of fabrics such as described in ASTM D1388-08 (2012) may also be used for measuring stiffness of materials for support layer 120.

As described above, adjacent support layer 120 on a rearward or underside portion of sleeping bag 10 is fill layer 130 of fill or cushioning material, which in a number of embodiments was a polyester fiber fill material (available, for example, from Fairfield Processing of Danbury, Conn. under the mark POLY-FIL®). In a number of embodiments, fill layer 130 was present only on the rearward of underside portion of sleeping bag 10 (adjacent the rear of the child) to provide cushioning as well as some rigidity or stability when sleeping bag 10 is placed, for example, a sitting position while in the "stuffed animal mode" as illustrated in FIG. 1. In the illustrated embodiment, no fill layer 130 was provided on the top of sleeping bag 10 (adjacent the front of the child) to, for example, prevent excessive bulk and overheating when in use as a sleeping bag. Adjacent to and outside of layer 120 in the illustrated embodiment is an outer, surface or fur layer 140 (in the case of a bear or other mammal) similar to that provide for stuffed animals. Fur layer 140 provides a soft, cuddly material which is common of stuffed animals, while layers 110, 120 and 130 provide comfort and resiliency consistent with the warmth and comfort of a sleeping bag.

In a number of embodiments, the layered structure described above (and particularly support layer 120) is adapted to retain the shape of sleeping bag 10 as a stuffed animal/character in those sections of sleeping bag 10 within internal compartments having relatively small volume (that is, within arms 40 and legs 50). In general, modelling the cross-section of the arms and legs as a generally circular, the materials forming sleeping bag 10 are preferably chosen such that a generally circular section formed form such materials and having a diameter of 6 inches (15.24 cm) does not collapse in height by not more than 20%, 10%, or even 5% when resting unsupported upon a flat surface (and wherein the volume or compartment formed therein is empty). A "substantial collapse" in height of limb of a sleeping bag hereon if a collapse of greater than 20% in height of the limb.

Figure 2D:
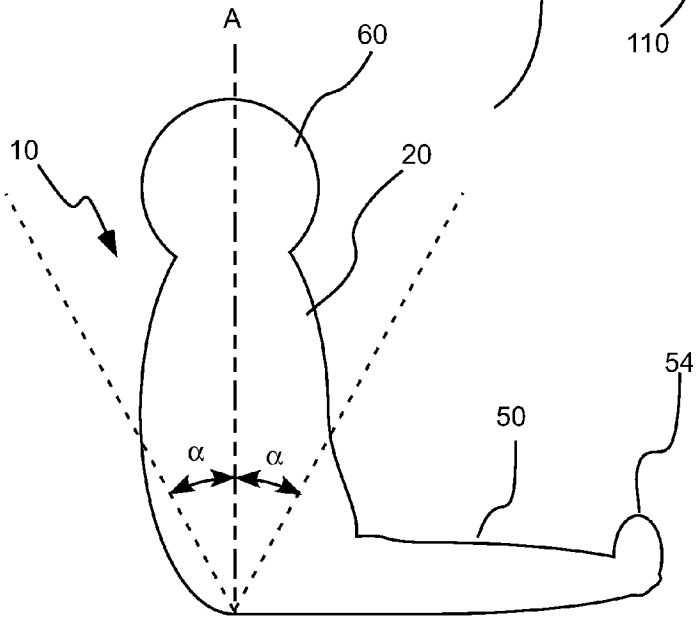
FIG. 2D illustrates a schematic side view of the sleeping bag of FIG. 1 in an unsupported, upright sitting position.
Figure 3:
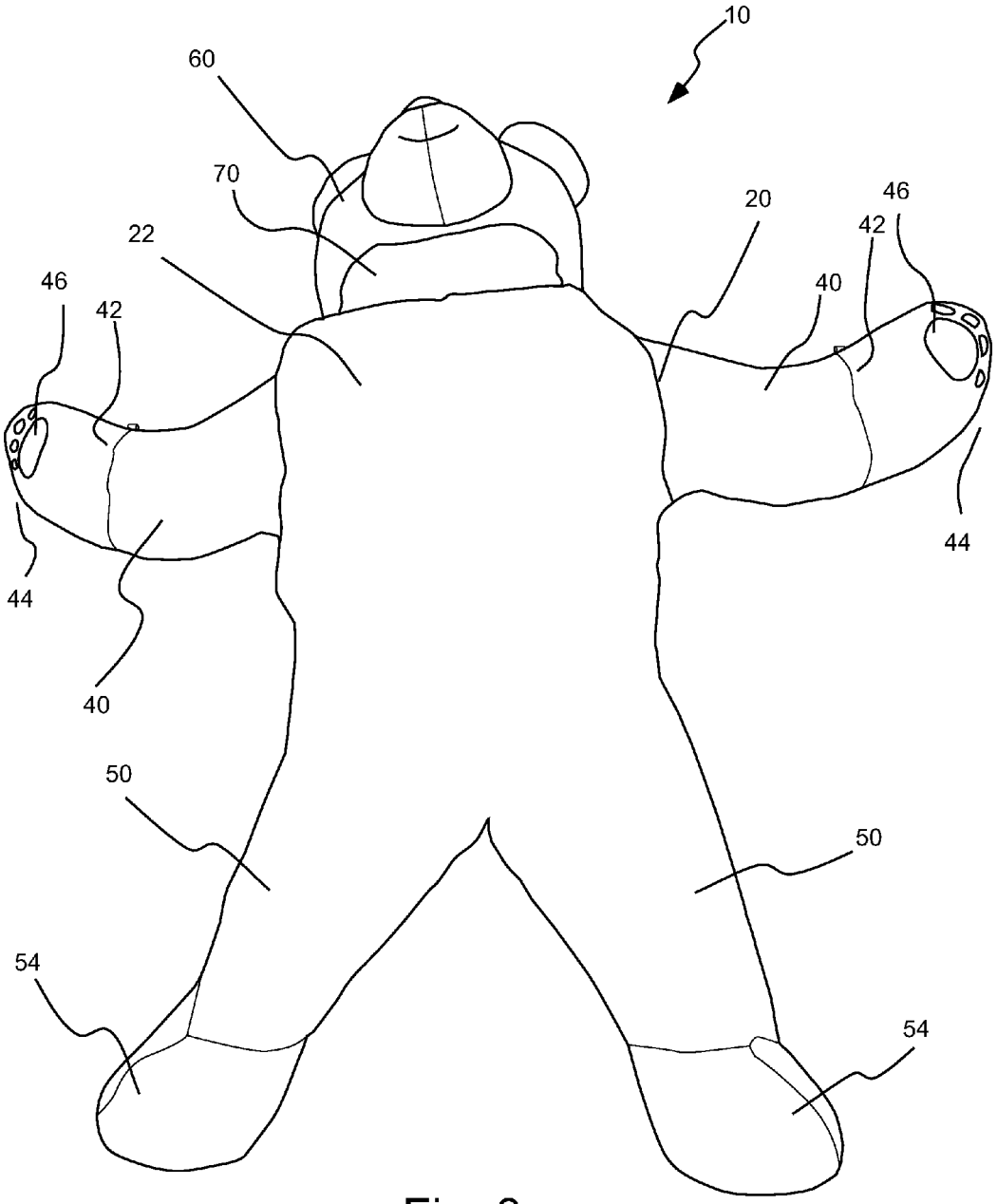
FIG. 3 illustrates a perspective view of the sleeping bag of FIG. 1 lying flat on a surface with the front thereof facing upward.

In the case of torso 20, the larger volume of compartment 30 and the associated increased surface area/span of torso 20 may result in a need for additional support, particularly to enable sleeping bag 10 to maintain itself in sitting position without resting against any object (see FIGS. 1 and 2D). In a number of embodiments, to provide support for torso 20 when the child is not using sleeping bag 10 as a sleeping bag, a removable item 200 (see, for example, FIG. 2A) is storable inside torso compartment 30 of sleeping bag 10 when sleeping bag 10 is used in the "stuffed animal mode". Item 200 may, for example, be a relatively small, removable padded bag which may serve as a stabilizer or support when stored within sleeping bag 10, as a travel case for the child when removed, and as an educational food source item of (or other item associated with) the animal type of sleeping bag 10. In the embodiment illustrated in FIGS. 1 through 6, item 200 is formed in the shape of a fish such as a salmon, which is a common food item for bears. In the case that item 200 acts as a stabilizer or support when stored in sleeping bag 10 (for example, to support sleeping bag 10 in an upright sitting position), item 200 may, for example, be at least 12 inches (30.48 cm) in length.

As illustrated, for example, in FIG. 2B, item 200 may include an opening formed via flaps or folds 210 to an internal compartment 220 into which a child may, for example, place other items such as overnight items (toothbrush, comb, clothing etc.). Flaps 210 may, for example, be openable and closable via cooperating hook-and-loop type fasteners 212 (for example, VELCRO hook-and-loop type fasteners).

In a number of embodiments, torso flap 22 includes an extra length of material in an upper region thereof to assist in fully covering a child's torso when the child is in sleeping bag 10. When not in use as a sleeping bag, the extra length of material may, for example, results in folds 24 (illustrated in dashed lines in FIG. 1) which may be tucked under head 60 to support head 60 when sleeping bag 10 is not in use as a sleeping bag. When not in use as a sleeping bag, sleeping bag 10 may assume the structure (that is, conformation, configuration, position and/or appearance) of a conventional stuffed animal, which is able to sit and remain upright as illustrated in FIG. 1. To further assist in maintaining the structure/conformation of a stuffed animal is a sitting position, paws 44 may, for example, include cooperating connectors such as hook-and-loop type connectors 46 (see, for example, FIGS. 3 and 5) so that arms 40 may be connected in front of sleeping bag 10 as illustrated in FIG. 1. Connecting arms 40 together as illustrated in FIG. 1 assists in maintaining the weight of sleeping bag 10 forward, which assists in maintaining an unsupported sitting position.

Figure 7A:
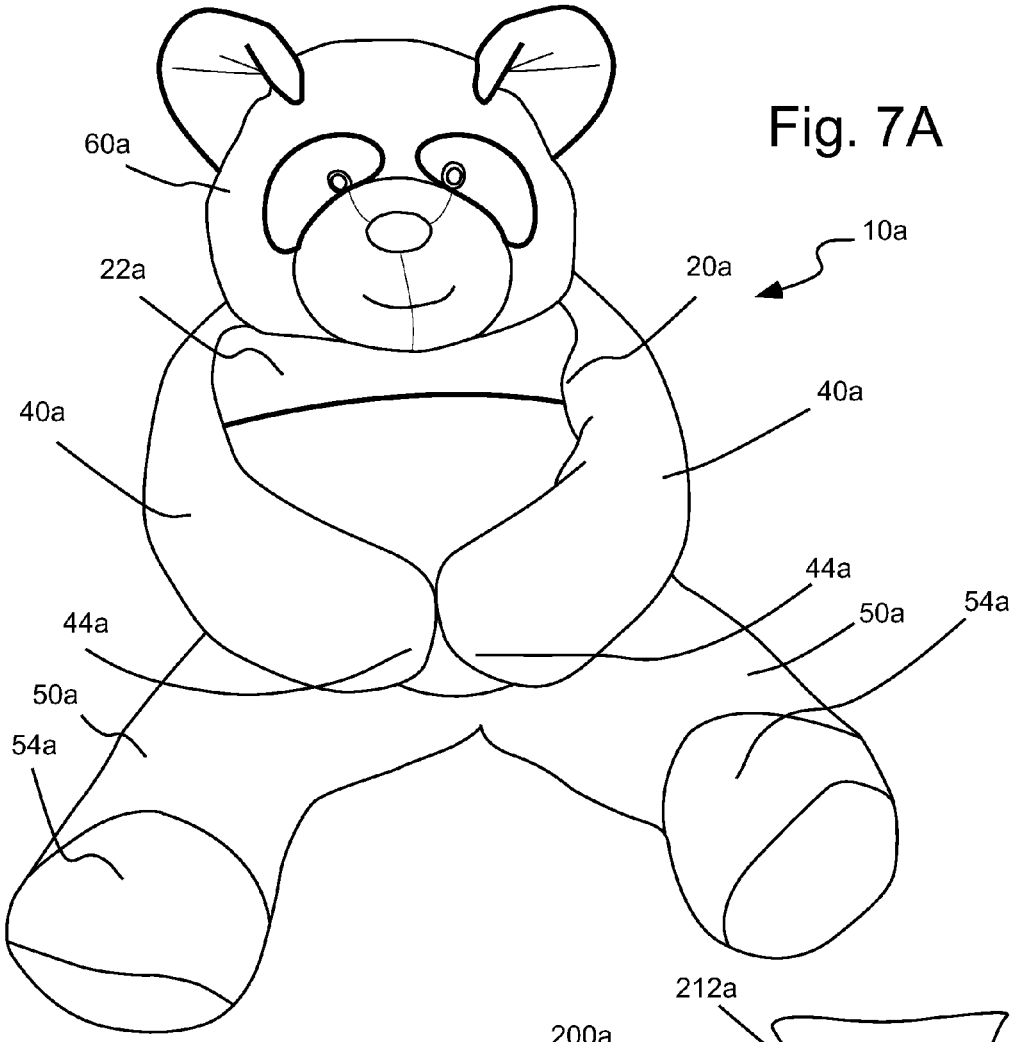
FIG. 7A illustrates a perspective view another embodiment of a sleeping bag hereof in the form of a panda bear in a sitting position.
Figure 7B:
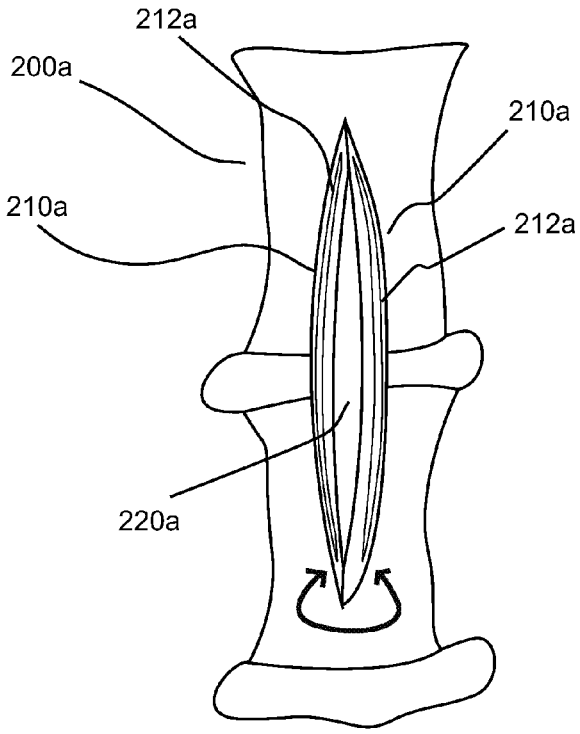
FIG. 7B illustrates an enlarged perspective view of a bamboo-shaped food item that may be used within the sleeping bag of FIG. 7A, which may serve as an overnight bag, and wherein the bamboo-shaped item is in a partially open state.

Many different types of animals can be represented in sleeping bags hereof. For example, FIG. 7A illustrates a panda bear sleeping bag 10*a* which is similar in operation and construction to sleeping bag 10. Elements of sleeping bag 10*a* are numbered similarly to corresponding elements of sleeping bag 10 with the addition of the designation "a" thereto. FIG. 7B illustrates an item 200*a* in the shape of a piece of bamboo (a food item for a panda bear) that can be placed within the torso compartment (not shown) of torso 20*a* of sleeping bag 10*a*. Item 200*a* is similar in operation and construction to item 200. Elements of item 200*a* are numbered similarly to corresponding elements of item 200 with the addition of the designation "a" thereto.

Figure 8A:
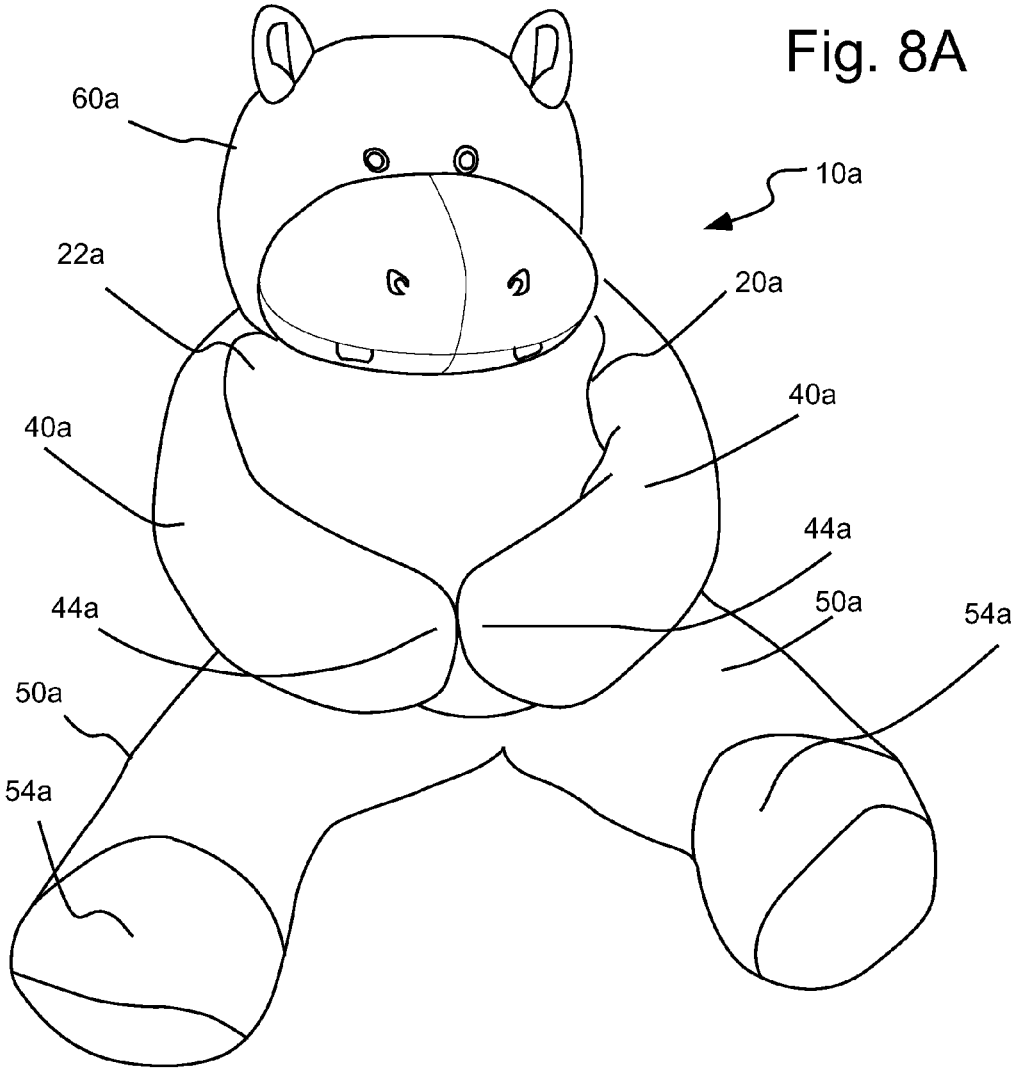
FIG. 8A illustrates a perspective view another embodiment of a sleeping bag hereof in the form of a hippopotamus, wherein the hippopotamus is in a sitting position.
Figure 8B:
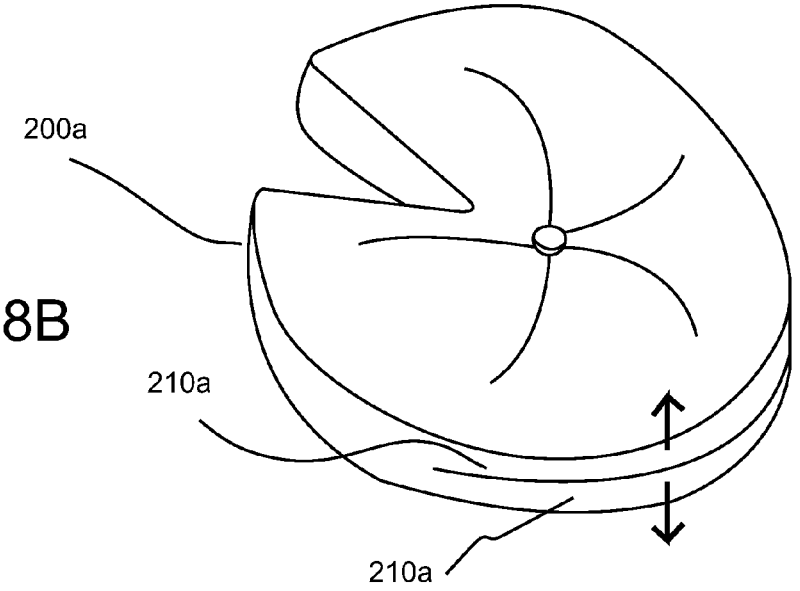
FIG. 8B illustrates an enlarged perspective view of a lily-pad-shaped food item that may be used within the sleeping bag of FIG. 7A, which may serve as an overnight bag, and wherein the lily-pad-shaped item is in a closed state.

FIG. 8A illustrates a hippopotamus sleeping bag 10*b* which is similar in operation and construction to sleeping bag 10. Elements of sleeping bag 10*b* are numbered similarly to corresponding elements of sleeping bag 10 with the addition of the designation "b" thereto. FIG. 8B illustrates an item 200*b* in the shape of a piece of a lily pad (a food item for a hippopotamus) that may be placed within the torso compartment (not shown) of torso 20*b* of sleeping bag 10*b*. Item 200*b* is similar in operation and construction to item 200. Elements of item 200*b* are numbered similarly to corresponding elements of item 200 with the addition of the designation "b" thereto.

In the case of, for example, a sleeping bag formed as a fish (not shown), the tail portion of the fish can provide a single leg compartment into which a child may place both of the child's legs. The child's arms may be placed into the fins of the fish-shaped sleeping bag. As described above, openings may be provided near the distal ends of the fins and the tail to provide access to the hands and feet, respectively, as well as to provide venting. The distal ends of the fins may include cooperating connectors as described above so that the fins may be connected in front of the fish to assist in maintaining an upright or sitting position. In the case of, for example, a sleeping bag formed as a bird (not shown) the legs of the bird may provide leg compartments as described above, and the wings of the bird may provide arm compartments. Once again, openings may be provided near the distal ends of the wings and the legs to provide access to the hands and feet, respectively, as well as to provide venting. The distal ends of the wings may include cooperating connectors as described above so that the wings may be connected in front of the bird to assist in maintaining an upright or sitting position. As also described above, the main body compartment or torso compartment of such sleeping bags may include an item which is placed therein (for example, a food or other item related to the type of character) to provide support.

The foregoing description and accompanying drawings set forth a number of representative embodiments at the present time. Various modifications, additions and alternative designs will, of course, become apparent to those skilled in the art in light of the foregoing teachings without departing from the scope hereof, which is indicated by the following claims rather than by the foregoing description. All changes and variations that fall within the meaning and range of equivalency of the claims are to be embraced within their scope.

What is claimed is:

1. A sleeping bag system having the appearance of a stuffed character when not in use as a sleeping bag, comprising: a torso having a torso compartment therein, a first limb having a first arm compartment therein which is in connection with the torso compartment, a second limb having a second arm compartment therein which is in connection with the torso compartment, at least a third limb having at least a first leg compartment therein which is in connection with the torso compartment, an opening in the torso providing access to the torso compartment from outside of the sleeping bag system, and a stuffed character head movably attached to the torso, the stuffed character head being movable rearward to create a head compartment in connection with the torso compartment, the torso compartment having sufficient rigidity to provide stability to the sleeping bag system such that the sleeping bag system can sit upright without support when not in use as a sleeping bag, wherein the torso compartment comprises a layer of material having rigidity such that a strip of the material having a width of 1 inch and a thickness in the range of 0.25 to 0.75 inches deflects no more than 45 degrees when extended over an edge of a surface to a length of 6 inches, wherein at least a portion of the first limb, at least a portion of the second limb, and at least a portion of the third limb, having sufficient rigidity to prevent substantial collapse of the first limb, the second limb, and the third limb when the sleeping bag is not in use as a sleeping bag, and wherein each of the at least a portion of the first limb, the at least a portion of the second limb, and the at least a portion of the third limb independently comprises a layer of material having sufficient rigidity such that a strip of the material having a width of 1 inch and a thickness in the range of 0.25 to 0.75 inches deflects no more than 45 degrees when extended over an edge of a surface to a length of 6 inches.

2. The sleeping bag system of claim 1 further comprising a fourth limb having a second leg compartment therein which is in connection with the torso compartment, at least a portion of the fourth limb comprising at least one layer of a flexible material having sufficient rigidity to substantially prevent substantial collapse of the fourth limb when the sleeping bag is not in use as a sleeping bag.

3. The sleeping bag system of claim 1 wherein the first limb includes a connector in the vicinity of a distal end of the first limb and the second limb includes a cooperating connector in the vicinity of a distal end of the second limb such that the first limb and the second limb are connectable in front of the torso.

4. The sleeping bag system of claim 3 wherein the connector and the cooperating connector are hook-and-loop type connectors.

5. The sleeping bag system of claim 3 wherein the head being tiltable rearward to create a head compartment in connection with the torso compartment.

6. The sleeping bag system of claim 5 wherein the first limb comprises an opening in the vicinity of the distal end thereof via which a first hand of a user of the sleeping bag can exit the sleeping bag and the second limb comprising an opening in the vicinity of the distal end thereof via which a second hand of a user of the sleeping bag can exit the sleeping bag.

7. The sleeping bag system of claim 6 wherein the third limb comprises an opening in the vicinity of the distal end thereof, and the fourth limb comprises an opening in the vicinity of the distal end thereof.

8. The sleeping bag system of claim 1 wherein the opening in the torso is a flap which is openable and closeable via at least one hook-and-loop type fastener.

9. The sleeping bag system of claim 1 wherein the stuffed character is a stuffed animal and further comprises an item removably storable in the torso compartment which is formed in the shape of a food item for the animal.

10. The sleeping bag system of claim 9 wherein the item includes an opening in connection with a storage compartment within the item.

11. The sleeping bag system of claim 10 wherein the item is an overnight bag.

12. The sleeping bag of claim 1 wherein the layer of material of the torso compartment has sufficient rigidity such that a strip of the material having a width of 1 inch and a thickness in the range of 0.25 to 0.75 inches deflects no more than 30 degrees when extended over an edge of a surface to a length of 6 inches and wherein each of the at least a portion of the first limb, and the layer of material of each of the at least a portion of the second limb, and the at least a portion of the third limb has sufficient rigidity such that a strip of the material having a width of 1 inch and a thickness in the range of 0.25 to 0.75 inches deflects no more than 30 degrees when extended over an edge of a surface to a length of 6 inches.

13. The sleeping bag system of claim 2 wherein the at least a portion of the fourth limb has sufficient rigidity to prevent substantial collapse of the fourth limb when the sleeping bag is not in use as a sleeping bag, and wherein the at least a portion of the fourth limb independently comprises a layer of material having rigidity such that a strip of the material having a width of 1 inch and a thickness in the range of 0.25 to 0.75 inches deflects no more than 45 degrees when extended over an edge of a surface to a length of 6 inches.

14. The sleeping bag of claim 13 wherein the layer of material of the torso compartment has sufficient rigidity such that a strip of the material having a width of 1 inch and a thickness in the range of 0.25 to 0.75 inches deflects no more than 30 degrees when extended over an edge of a surface to a length of 6 inches and wherein the layer of material of each of the at least a portion of the first limb, the at least a portion of the second limb, and the at least a portion of the third limb and the at least a portion of the fourth limb has sufficient rigidity such that a strip of the material having a width of 1 inch and a thickness in the range of 0.25 to 0.75 inches deflects no more than 30 degrees when extended over an edge of a surface to a length of 6 inches.

15. A method of fabricating a sleeping bag system having the appearance of a stuffed character when not in use as a sleeping bag, comprising: providing a torso having a torso compartment therein, providing a first limb in connection with the torso having a first arm compartment therein which is in connection with the torso compartment, providing a second limb in connection with the torso having a second arm compartment therein which is in connection with the torso compartment, providing at least a third limb in connection with the torso having at least a first leg compartment therein which is in connection with the torso compartment, providing a stuffed character head movably attached to the torso, the stuffed character head being movable rearward to create a head compartment in connection with the torso compartment, providing an opening in the torso to provide access to the torso compartment from outside of the sleeping bag system, and providing an item removably storable in the torso compartment, wherein the torso compartment has sufficient rigidity and the item is configured to provide stability to the sleeping bag system such that the sleeping bag system can sit upright without support when not in use as a sleeping bag, wherein at least a portion of the first limb, at least a portion of the second limb, and at least a portion of the third limb, is fabricated to have sufficient rigidity to prevent substantial collapse of the first limb, the second limb, and the third limb when the sleeping bag is not in use as a sleeping bag, and wherein the torso compartment and each of the at least a portion of the first limb, the at least a portion of the second limb, and the at least a portion of the third limb independently comprises a layer of material having sufficient rigidity such that a strip of the material having a width of 1 inch and a thickness in the range of 0.25 to 0.75 inches deflects no more than 45 degrees when extended over an edge of a surface to a length of 6 inches.

16. The method of claim 15 wherein the layer of material of the torso compartment has sufficient rigidity such that a strip of the material having a width of 1 inch and a thickness in the range of 0.25 to 0.75 inches deflects no more than 30 degrees when extended over an edge of a surface to a length of 6 inches and wherein the layer of material of each of the at least a portion of the first limb, the at least a portion of the second limb, and the at least a portion of the third limb has sufficient rigidity such that a strip of the material having a width of 1 inch and a thickness in the range of 0.25 to 0.75 inches deflects no more than 30 degrees when extended over an edge of a surface to a length of 6 inches.

17. A method of fabricating a sleeping bag system having the appearance of a stuffed character when not in use as a sleeping bag, comprising: providing a torso having a torso compartment therein, providing a first limb in connection with the torso having a first arm compartment therein which is in connection with the torso compartment, providing a second limb in connection with the torso having a second arm compartment therein which is in connection with the torso compartment, providing at least a third limb in connection with the torso having a first leg compartment therein which is in connection with the torso compartment, providing an opening in the torso providing access to the torso compartment, and providing a stuffed character head movably attached to the torso so that the head may be tilted rearward to create head compartment, which is connected to the torso compartment, the torso compartment is fabricated to have sufficient rigidity to prevent substantial collapse of the torso compartment when the sleeping bag is not in use as a sleeping bag and wherein at least a portion of the first limb, at least a portion of the second limb, and at least a portion of the third limb, is fabricated to have sufficient rigidity to prevent substantial collapse of the first limb, the second limb, and the third limb when the sleeping bag is not in use as a sleeping bag, and wherein the torso compartment and each of the at least a portion of the first limb, the at least a portion of the second limb, and the at least a portion of the third limb independently comprises a layer of material having sufficient rigidity such that a strip of the material having a width of 1 inch and a thickness in the range of 0.25 to 0.75 inches deflects no more than 45 degrees when extended over an edge of a surface to a length of 6 inches.

18. The method of claim 17 wherein the layer of material of the torso compartment has sufficient rigidity such that a strip of the material having a width of 1 inch and a thickness in the range of 0.25 to 0.75 inches deflects no more than 30 degrees when extended over an edge of a surface to a length of 6 inches and wherein the layer of material of each of the at least a portion of the first limb, the at least a portion of the second limb, and the at least a portion of the third limb has sufficient rigidity such that a strip of the material having a width of 1 inch and a thickness in the range of 0.25 to 0.75 inches deflects no more than 30 degrees when extended over an edge of a surface to a length of 6 inches.

* * * * *